US010431863B2

(12) United States Patent
Suchen

(10) Patent No.: US 10,431,863 B2
(45) Date of Patent: Oct. 1, 2019

(54) BAND-PASS FILTER DEVICE AND METHOD FOR SIGNAL TRANSMISSION

(71) Applicant: Wistron NeWeb Corp., Hsinchu (TW)

(72) Inventor: Hung-Ju Suchen, Hsinchu (TW)

(73) Assignee: Wistron NeWeb Corp., Hsinchu (TW)

( * ) Notice: Subject to any disclaimer, the term of this patent is extended or adjusted under 35 U.S.C. 154(b) by 131 days.

(21) Appl. No.: 15/853,307

(22) Filed: Dec. 22, 2017

(65) Prior Publication Data

US 2019/0036192 A1 Jan. 31, 2019

(30) Foreign Application Priority Data

Jul. 31, 2017 (TW) ..... 106125719 A

(51) Int. Cl.

| | |
|---|---|
| ***H01Q 1/38*** | (2006.01) |
| ***H01P 1/213*** | (2006.01) |
| ***H01Q 15/14*** | (2006.01) |
| ***H01Q 13/08*** | (2006.01) |
| ***H01P 1/02*** | (2006.01) |
| ***H01P 1/211*** | (2006.01) |
| *H01P 5/107* | (2006.01) |

(52) U.S. Cl.

CPC ..... *H01P 1/2138* (2013.01); *H01P 1/027* (2013.01); *H01P 1/211* (2013.01); *H01Q 1/38* (2013.01); *H01Q 13/08* (2013.01); *H01Q 15/141* (2013.01); *H01P 1/025* (2013.01); *H01P 5/107* (2013.01)

(58) Field of Classification Search

CPC ..... H01Q 1/38; H01Q 13/08; H01Q 15/14; H01P 1/21; H01P 1/02

USPC ..... 343/835

See application file for complete search history.

(56) References Cited

U.S. PATENT DOCUMENTS

2012/0013425 A1* 1/2012 Tor ..... H01P 1/122 335/256

FOREIGN PATENT DOCUMENTS

WO 2014/016587 A1 1/2014

OTHER PUBLICATIONS

European Search Report dated Aug. 6, 2018, issued in application No. 18156768.-1205.

* cited by examiner

*Primary Examiner* — Andrea Lindgren Baltzell

(74) *Attorney, Agent, or Firm* — McClure, Qualey & Rodack, LLP

(57) ABSTRACT

A band-pass filter device includes a waveguide filter, a first circuit board section, a first antenna, a second circuit board section, and a second antenna. The waveguide filter includes a high-pass portion, a connection portion, and a low-pass portion. The first antenna is disposed on the first circuit board section. The second antenna is disposed on the second circuit board section. A wireless signal generated by the first antenna is transmitted through the high-pass portion, the connection portion, and the low-pass portion of the waveguide filter, and then is received by the second antenna.

19 Claims, 13 Drawing Sheets

BAND-PASS FILTER DEVICE AND METHOD FOR SIGNAL TRANSMISSION

CROSS REFERENCE TO RELATED APPLICATIONS

This Application claims priority of Taiwan Patent Application No. 106125719 filed on Jul. 31, 2017, the entirety of which is incorporated by reference herein.

BACKGROUND OF THE INVENTION

Field of the Invention

The disclosure generally relates to a band-pass filter device, and more particularly, to a band-pass filter device for improving the communication quality.

Description of the Related Art

A conventional transmitter module usually uses a microstrip-line filter to remove undesired signal frequencies. However, the insertion loss of the microstrip-line filter is relatively high (e.g., 3 dB to 7 dB), and this drawback indeed sacrifices the communication quality of the transmitter module. In addition, the microstrip-line filter is very sensitive to variations in the manufacturing process. Even a minor error during the manufacturing process causes the operation frequency band of the microstrip-line filter to shift significantly. Accordingly, there is a need to propose a novel solution superior to the prior arts.

BRIEF SUMMARY OF THE INVENTION

In an exemplary embodiment, a band-pass filter device is provided and includes a waveguide filter, a first circuit board section, a first antenna, a second circuit board section, and a second antenna. The waveguide filter includes a waveguide chamber. The waveguide chamber includes a high-pass portion, a connection portion, and a low-pass portion. The first antenna is disposed on the first circuit board section. The second antenna is disposed on the second circuit board section. A wireless signal generated by the first antenna is transmitted through the high-pass portion, the connection portion, and the low-pass portion of the waveguide filter, and then is received by the second antenna.

In another exemplary embodiment, a method for signal transmission is provided. The method includes the steps of providing a waveguide filter, a first antenna, a second antenna, a first circuit board section, and a second circuit board section, wherein the waveguide filter comprises a high-pass portion and a low-pass portion, wherein the first antenna is disposed on the first circuit board section, and wherein the second antenna is disposed on the second circuit board section; transmitting a first wired signal from the first circuit board section to the first antenna; using the first antenna to convert the first wired signal into a wireless signal; transmitting the wireless signal through the high-pass portion and the low-pass portion of the waveguide filter; using the second antenna to receive the wireless signal; and converting the wireless signal into a second wired signal, and transmitting the second wired signal to the second circuit board section.

In another exemplary embodiment, an outdoor unit is provided and includes a band-pass filter device and a frequency division element. The band-pass filter device includes a waveguide filter, a first circuit board section, a first antenna, a second circuit board section, and a second antenna. The waveguide filter includes a waveguide chamber. The waveguide chamber includes a high-pass portion, a connection portion, and a low-pass portion. The first antenna is disposed on the first circuit board section. The second antenna is disposed on the second circuit board section. A wireless signal generated by the first antenna is transmitted through the high-pass portion, the connection portion, and the low-pass portion of the waveguide filter, and then is received by the second antenna. The frequency division element is coupled through an RF (Radio Frequency) printed circuit board to the band-pass filter device. The frequency division element includes a first waveguide. The first waveguide at least includes a first descending portion and a first terminal bending portion connected to each other. The first terminal bending portion has a first chamfer angle. The first descending portion causes an edge of the first chamfer angle to be aligned with a parting line.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
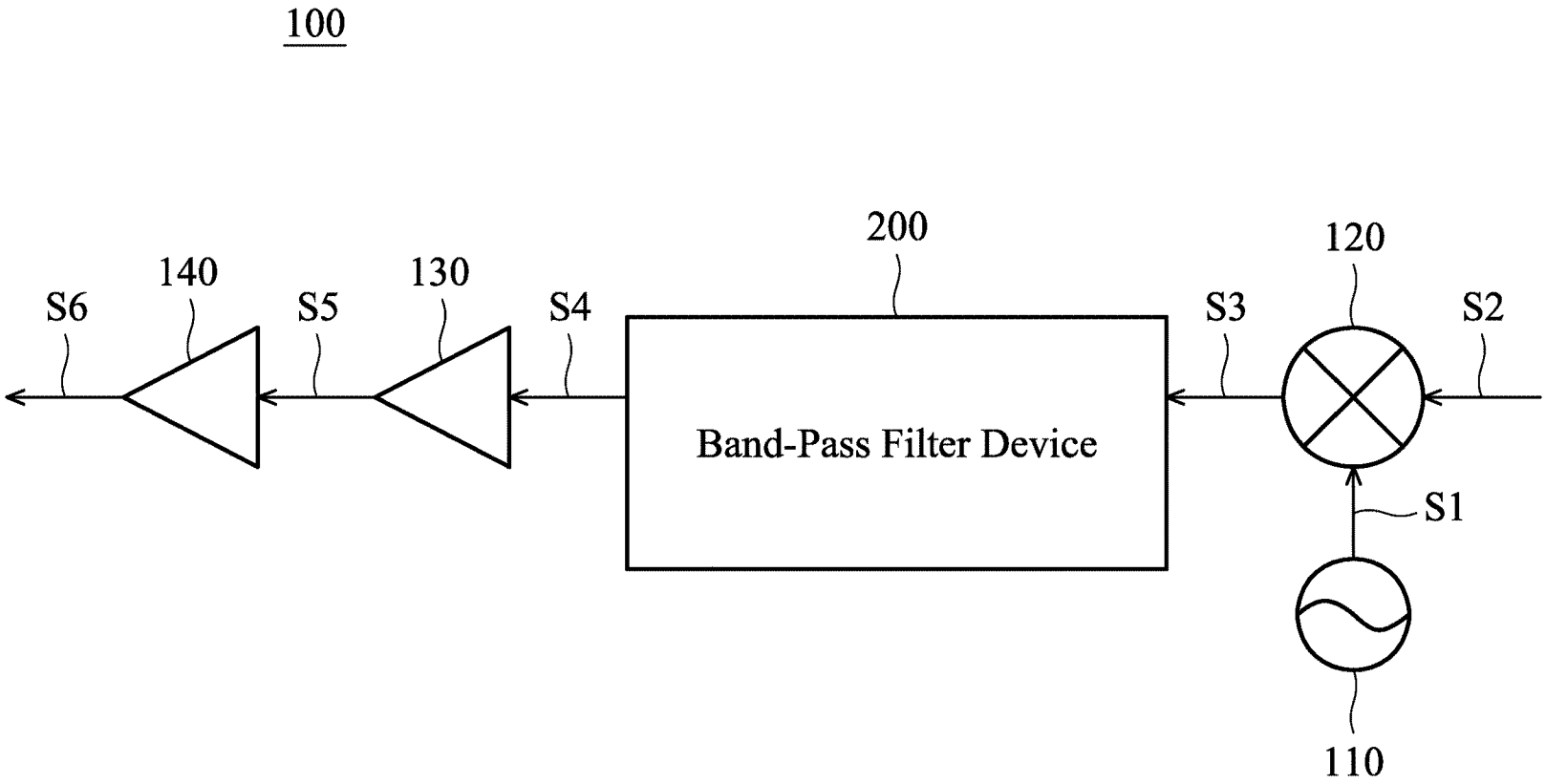
FIG. 1 is a diagram of a transmitter module according to an embodiment of the invention.

FIG. 1 is a diagram of a transmitter module 100 according to an embodiment of the invention. In the embodiment of FIG. 1, the transmitter module 100 includes a local oscillator 110, a mixer 120, a band-pass filter device 200, a driver amplifier 130, and a power amplifier 140. The local oscillator 110 generates an oscillator signal S1. The mixer 120 generates a mixed signal S3 according to the oscillator signal S1 and an IF (Intermediate Frequency) signal S2. The band-pass filter device 200 removes undesired frequency components in the mixed signal S3, so as to generate a filtered signal S4. The driver amplifier 130 processes the filtered signal S4, so as to generate a first amplified signal S5. The power amplifier 140 amplifies the first amplified signal S5, so as to generate a second amplified signal S6.

Figure 2:
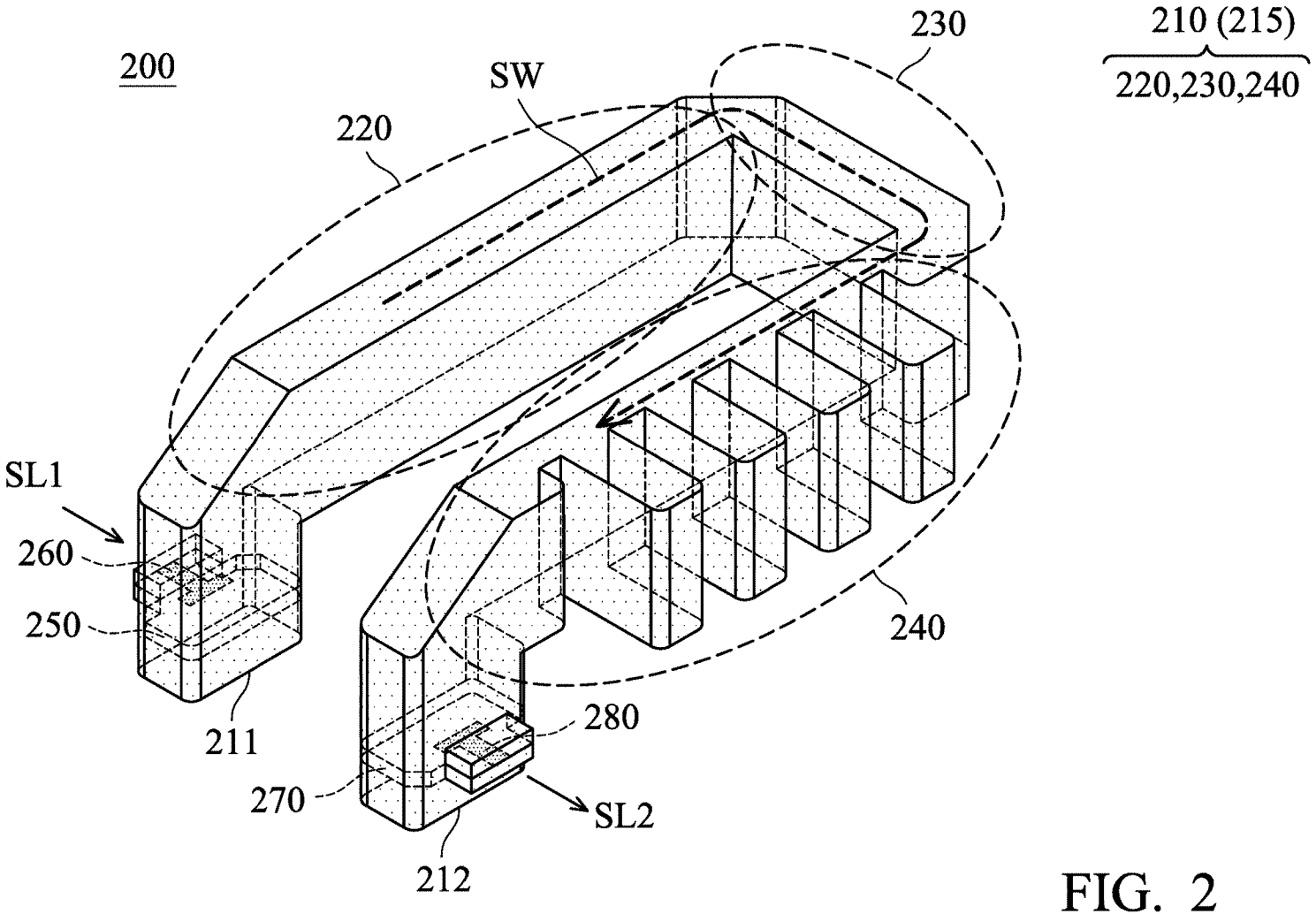
FIG. 2 is a perspective view of a band-pass filter device according to an embodiment of the invention.

FIG. 2 is a perspective view of the band-pass filter device 200 according to an embodiment of the invention. In the embodiment of FIG. 2, the band-pass filter device 200 includes a waveguide filter 210, a first circuit board section 250, a first antenna 260, a second circuit board section 270, and a second antenna 280. The waveguide filter 210 may be a U-shaped metal hollow structure which has a first reflection end 211 and a second reflection end 212. Specifically, the waveguide filter 210 includes a waveguide chamber 215. The waveguide chamber 215 includes a high-pass portion 220, a connection portion 230, and a low-pass portion 240. The connection portion 230 of the waveguide filter 210 is positioned between the high-pass portion 220 and the low-pass portion 240 of the waveguide filter 210. For example, the high-pass portion 220 of the waveguide filter 210 may be a simple rectangular metal tube. Frequency of the electromagnetic waves lower than a low cut-off frequency of the rectangular metal tube, cannot pass through the high-pass portion 220 of the waveguide filter 210. The low-pass portion 240 of the waveguide filter 210 may be a corrugated-waveguide filter. Frequency of the electromagnetic waves higher than a high cut-off frequency of the corrugated-waveguide filter, cannot pass through the low-pass portion 240 of the waveguide filter 210. The connection portion 230 of the waveguide filter 210 may be another metal tube arranged for connecting the high-pass portion 220 of the waveguide filter 210 to the low-pass portion 240 of the waveguide filter 210. In addition, the connection portion 230 may also have the function of high-pass filtering. For instance, when the connection portion 230 is capable of high-pass filtering, a high-pass filter can be formed of the connection portion 230 and the high-pass portion 220. It should be noted that the shape of the waveguide filter 210 is not limited in the invention. In alternative embodiments, the waveguide filter 210 substantially has a straight-line shape, an S-shape, or a V-shape. The cross section of the waveguide filter 210 may substantially have a rectangular shape, a square shape, or a circular shape, without affecting the performance of the invention.

Each of the first circuit board section 250 and the second circuit board section 270 may be a dielectric substrate or a printed circuit board. The shapes and types of the first antenna 260 and the second antenna 280 are not limited in the invention. For example, each of the first antenna 260 and the second antenna 280 may be a monopole antenna, a dipole antenna, a patch antenna, or a bowtie antenna. In the embodiment of FIG. 2, each of the first antenna 260 and the second antenna 280 is a T-shaped metal sheet. The first antenna 260 is printed on the first circuit board section 250. The second antenna 280 is printed on the second circuit board section 270. In alternative embodiments, adjustments can be made such that each of the first antenna 260 and the second antenna 280 can also be formed in different geometrical shapes such as an L-shape or a straight-line shape. Specifically, the first antenna 260 and the first circuit board section 250 are adjacent to the first reflection end 211 of the waveguide filter 210, and the second antenna 280 and the second circuit board section 270 are adjacent to the second reflection end 212 of the waveguide filter 210. For example, the first antenna 260 and the first circuit board section 250 may be embedded in an end portion that includes the first reflection end 211, and the second antenna 280 and the second circuit board section 270 may be embedded in the other end portion that includes the second reflection end 212.

The operation theory of the band-pass filter device 200 may be illustrated as follows. The first circuit board section 250 and the traces thereon (not shown) are configured to transmit a first wired signal SL1. The first antenna 260 is configured to convert the first wired signal SL1 into a wireless signal SW. The wireless signal SW generated by the first antenna 260 is transmitted through the high-pass portion 220, the connection portion 230, and the low-pass portion 240 of the waveguide filter 210, and then is received by the second antenna 280. Next, the second antenna 280 is configured to convert the wireless signal SW into a second wired signal SL2. The second circuit board section 270 and the traces thereon (not shown) are configured to transmit the second wired signal SL2.

Figure 3:
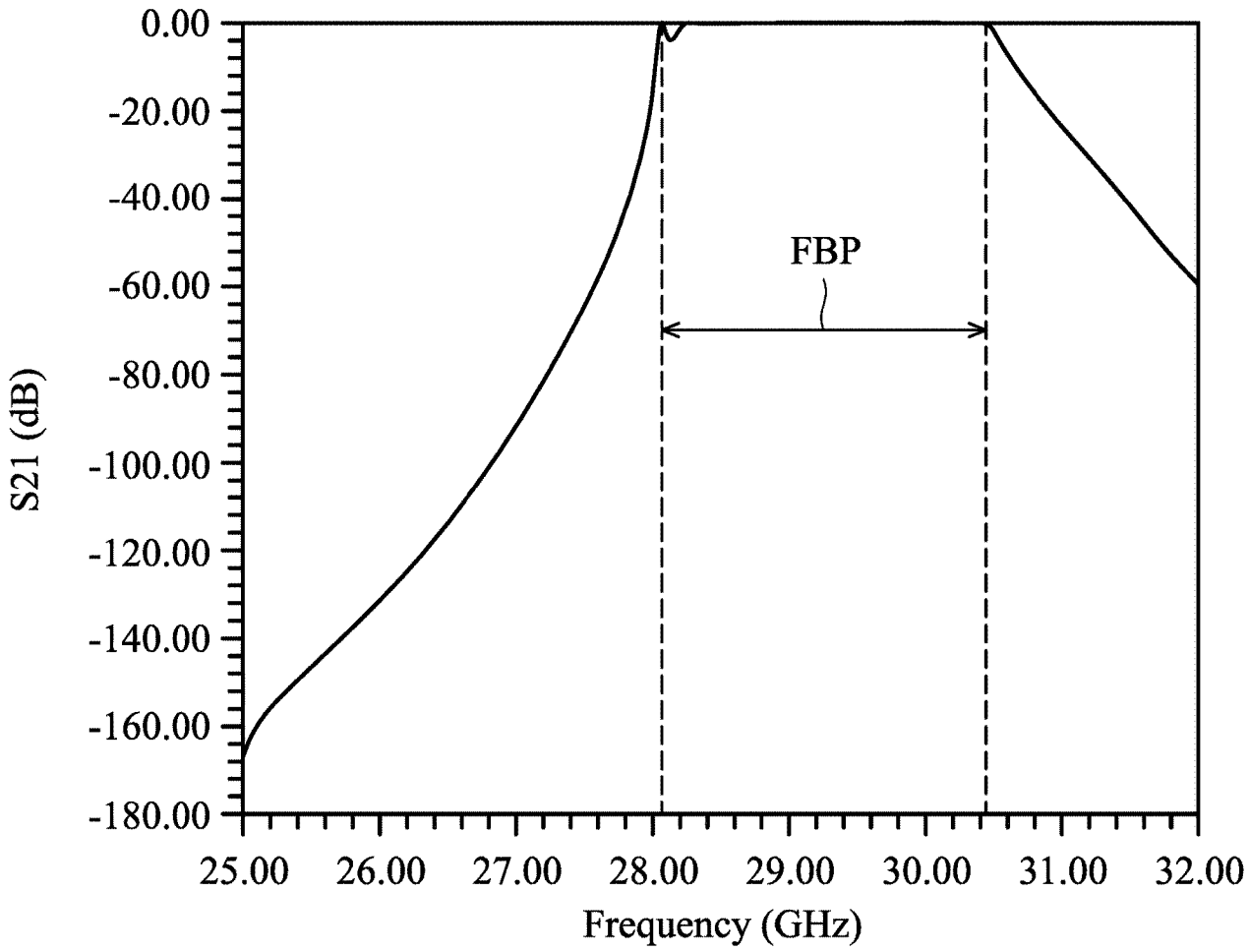
FIG. 3 is a diagram of S-parameter of a band-pass filter device according to an embodiment of the invention.

FIG. 3 is a diagram of S-parameter of the band-pass filter device 200 according to an embodiment of the invention. The horizontal axis represents the operation frequency (GHz), and the vertical axis represents the S21 (or S12) parameter (dB). A first port (Port 1) may be set at the first antenna 260 in the first reflection end 211 of the waveguide filter 210. A second port (Port 2) may be set at the second antenna 280 in the second reflection end 212 of the waveguide filter 210. The S21 (or S12) parameter between the first port and the second port is displayed in FIG. 3. According to the measurement of FIG. 3, the waveguide filter 210 can merely pass the signals whose frequency is within a work frequency band FBP, and remove the other frequency signals. For example, the work frequency band FBP may be from 28 GHz to 30.5 GHz. The high-pass portion 220 of the waveguide filter 210 is configured to remove the electromagnetic waves whose frequency is lower than 28 GHz. The low-pass portion 240 of the waveguide filter 210 is configured to remove the electromagnetic waves whose frequency is higher than 30.5 GHz. In other embodiments, the work frequency band FBP of the waveguide filter 210 is adjustable according to different requirements.

The band-pass filter device 200 of the invention uses the waveguide filter 210, rather than conventional microstrip-line filters. It should be noted that, while comparing with conventional microstrip-line filters, the proposed waveguide filter 210 of the invention only has a very minor insertion loss (e.g., only from about 0.2 dB to about 0.5 dB), which is superior to the conventional ones that has insertion loss 6 to 35 times higher than the present invention, and is insensitive to the variations in the manufacturing process, thereby effectively improving the signal quality and stability of the band-pass filter device 200. In addition, the high-pass portion 220 and the low-pass portion 240 of the waveguide filter 210 can be independently fine-tuned (in comparison, the microstrip-line filter cannot independently fine-tune its high and low band rejection), so as to increase the design flexibility of the band-pass filter device 200.

Figure 4:
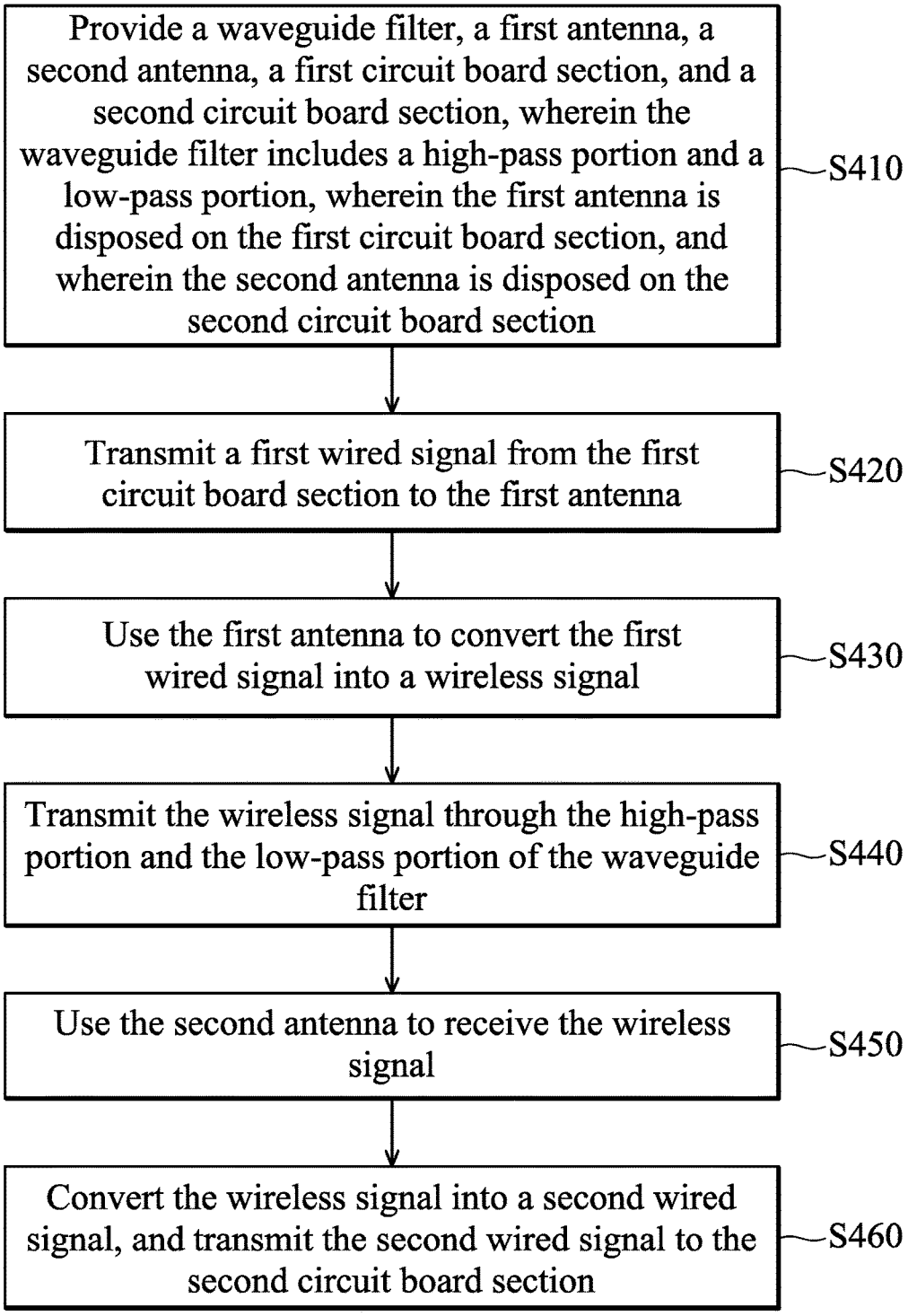
FIG. 4 is a flowchart of a method for signal transmission according to an embodiment of the invention.

FIG. 4 is a flowchart of a method for signal transmission according to an embodiment of the invention. The method for signal transmission includes the following steps. In step S410, a waveguide filter, a first antenna, a second antenna, a first circuit board section, and a second circuit board section are provided. The waveguide filter includes a high-pass portion and a low-pass portion. The first antenna is disposed on the first circuit board section. The second antenna is disposed on the second circuit board section. In step S420, a first wired signal is transmitted from the first circuit board section to the first antenna. In step S430, the first antenna is used to convert the first wired signal into a wireless signal. In step S440, the wireless signal is transmitted through the high-pass portion and the low-pass portion of the waveguide filter. In step S450, the second antenna is used to receive the wireless signal. In step S460, the wireless signal is converted into a second wired signal, and the second wired signal is transmitted to the second circuit board section.

Figure 5:
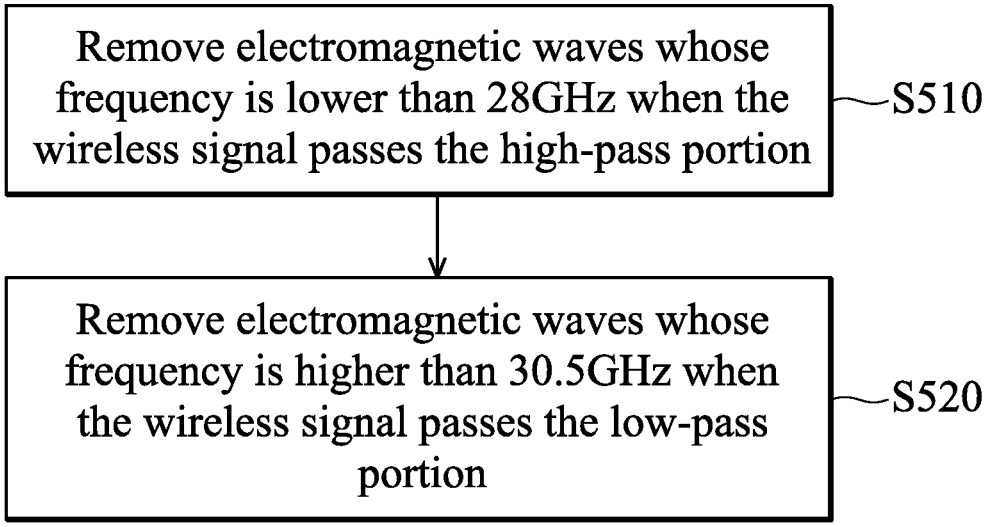
FIG. 5 is a flowchart of a method for signal transmission according to an embodiment of the invention.

FIG. 5 is a flowchart of the method for signal transmission according to an embodiment of the invention. In the embodiment of FIG. 5, the aforementioned method for signal transmission further includes the following steps. In step S510, when the wireless signal passes through the high-pass portion, the electromagnetic waves whose frequency is lower than 28 GHz are removed. In step S520, when the wireless signal passes through the low-pass portion, the electromagnetic waves whose frequency is higher than 30.5 GHz are removed. It should be noted that the steps of FIGS. 4 and 5 are not required to be sequentially performed, and every feature of the band-pass filter device 200 of FIGS. 1 to 3 may be applied to the method of FIGS. 4 and 5.

Figure 6A:
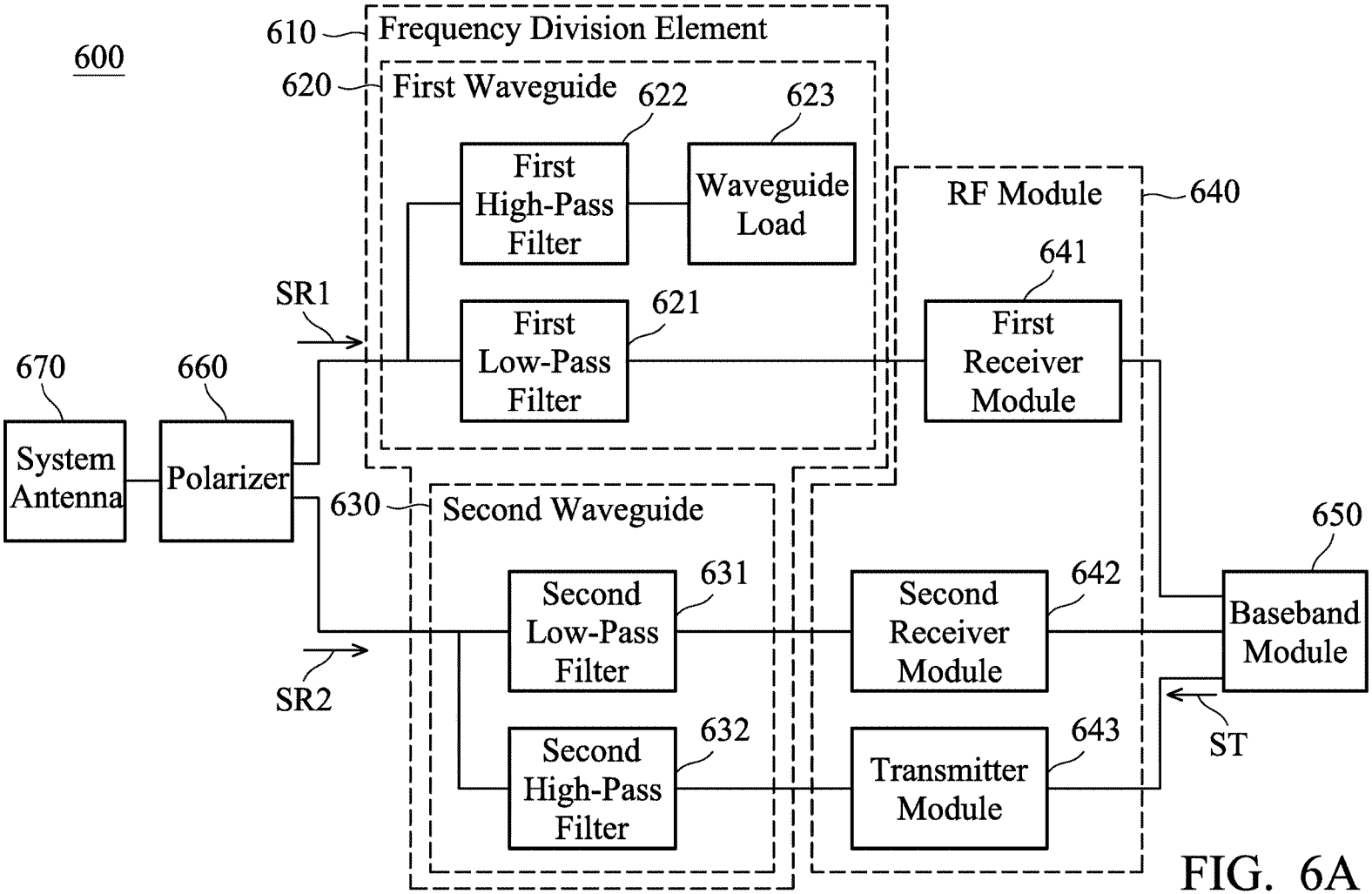
FIG. 6A is a diagram of an outdoor unit according to an embodiment of the invention.

FIG. 6A is a diagram of an ODU (Outdoor Unit) 600 according to an embodiment of the invention. The outdoor unit 600 may be disposed outside a house and arranged for satellite communications. In the embodiment of FIG. 6A, the outdoor unit 600 includes a frequency division element 610, an RF (Radio Frequency) module 640, a baseband module 650, a polarizer 660, and a system antenna 670. For example, the frequency division element 610 may be a waveguide diplexer for separating low-frequency signals from high-frequency signals. The frequency division element 610 includes at least one of a first waveguide 620 and a second waveguide 630. In some embodiments, the first waveguide 620 includes a first low-pass filter 621, a first high-pass filter 622, and a waveguide load 623; the second waveguide 630 includes a second low-pass filter 631 and a second high-pass filter 632. The RF module 640 includes one or more of a first receiver module 641, a second receiver module 642, and a transmitter module 643. The transmitter module 643 may include the aforementioned band-pass filter device 200. The outdoor unit 600 has one or more of the following three signal paths. The system antenna 670 and the polarizer 660 can receive and process a first reception signal SR1 and a second reception signal SR2. The first reception signal SR1 is transferred through the first low-pass filter 621 and the first receiver module 641 to the baseband module 650, so as to form a first signal path. The second reception signal SR2 is transferred through the second low-pass filter 631 and the second receiver module 642 to the baseband module 650, so as to form a second signal path. The baseband module 650 generates a transmission signal ST (e.g., the transmission signal ST may be the aforementioned IF signal S2). The transmission signal ST is transferred through the transmitter module 643 and the second high-pass filter 632 to the polarizer 660 and the system antenna 670, so as to form a third signal path.

Figure 6B:
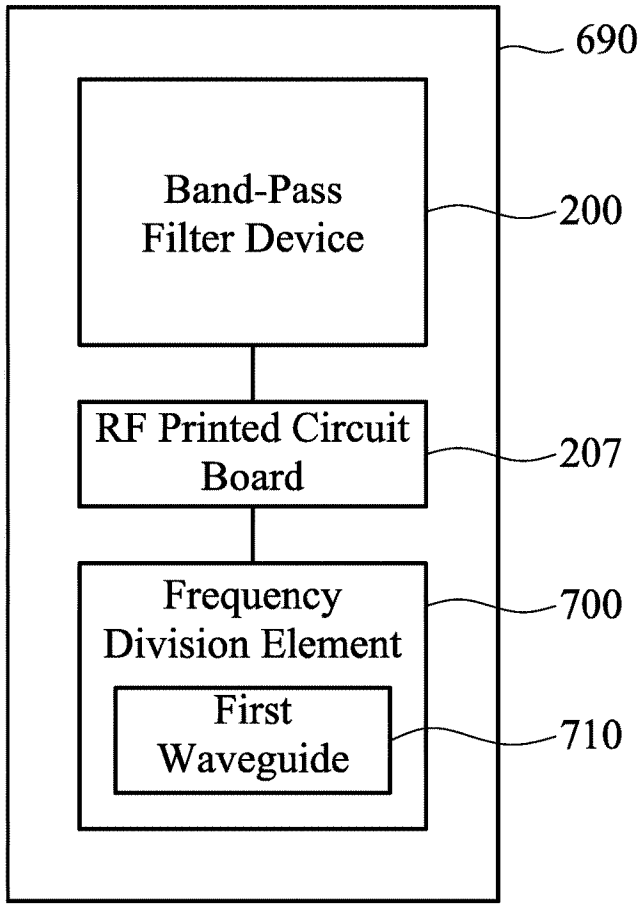
FIG. 6B is a diagram of an outdoor unit according to another embodiment of the invention.

FIG. 6B is a diagram of an outdoor unit 690 according to another embodiment of the invention. In the embodiment of FIG. 6B, the outdoor unit 690 at least includes a band-pass filter device 200 and a frequency division element 700. The frequency division element 700 at least includes a first waveguide 710. The frequency division element 700 may be coupled through an RF printed circuit board 207 to the band-pass filter device 200. The RF printed circuit board 207 can carry and support the aforementioned RF module 640. The structure and function of the band-pass filter device 200 have been described in the embodiment of FIGS. 1 to 3. The following embodiments will introduce the detailed structure and operation of the frequency division element 700.

Figure 7A:
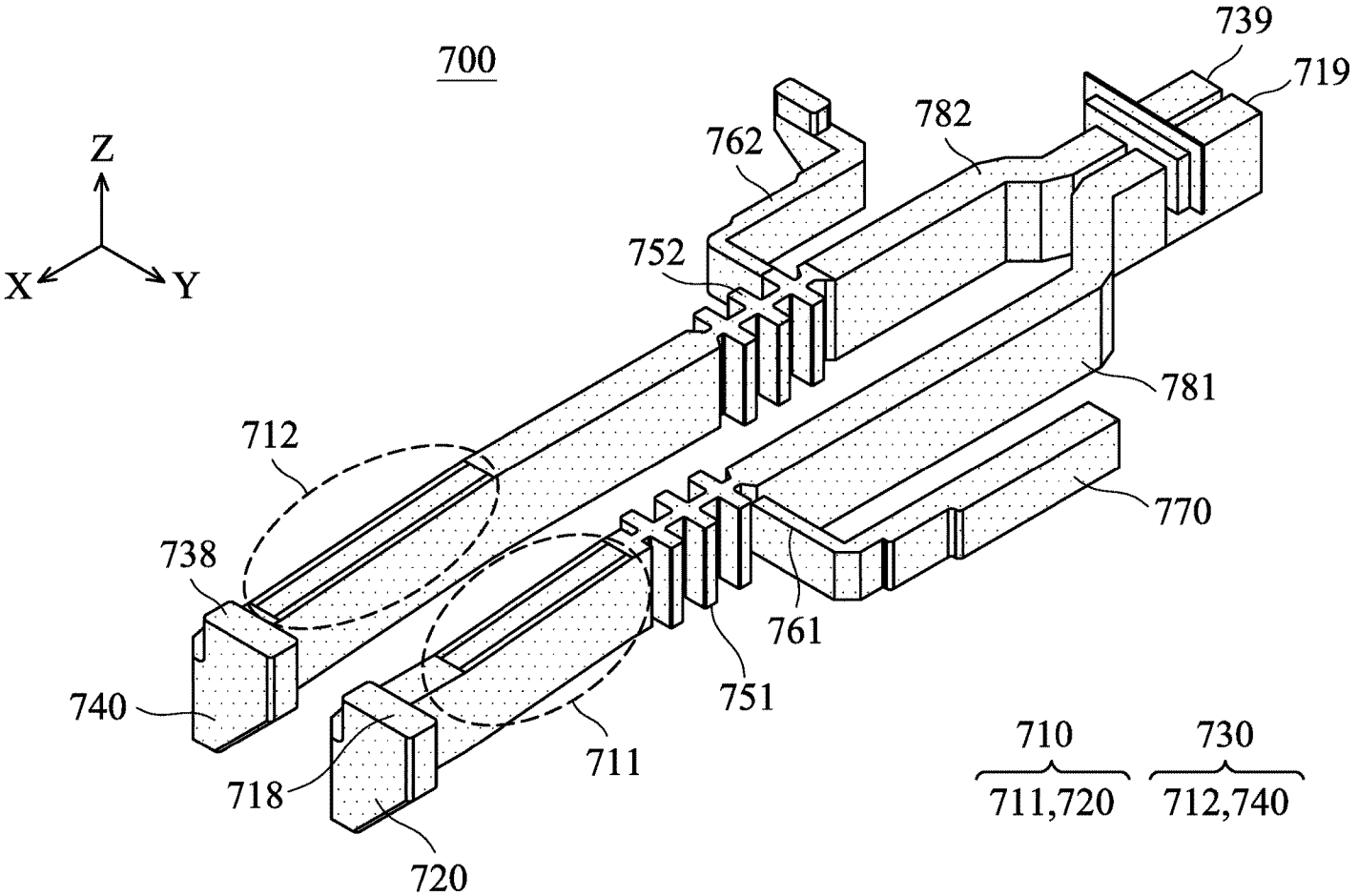
FIG. 7A is a perspective view of a frequency division element according to an embodiment of the invention.
Figure 7B:
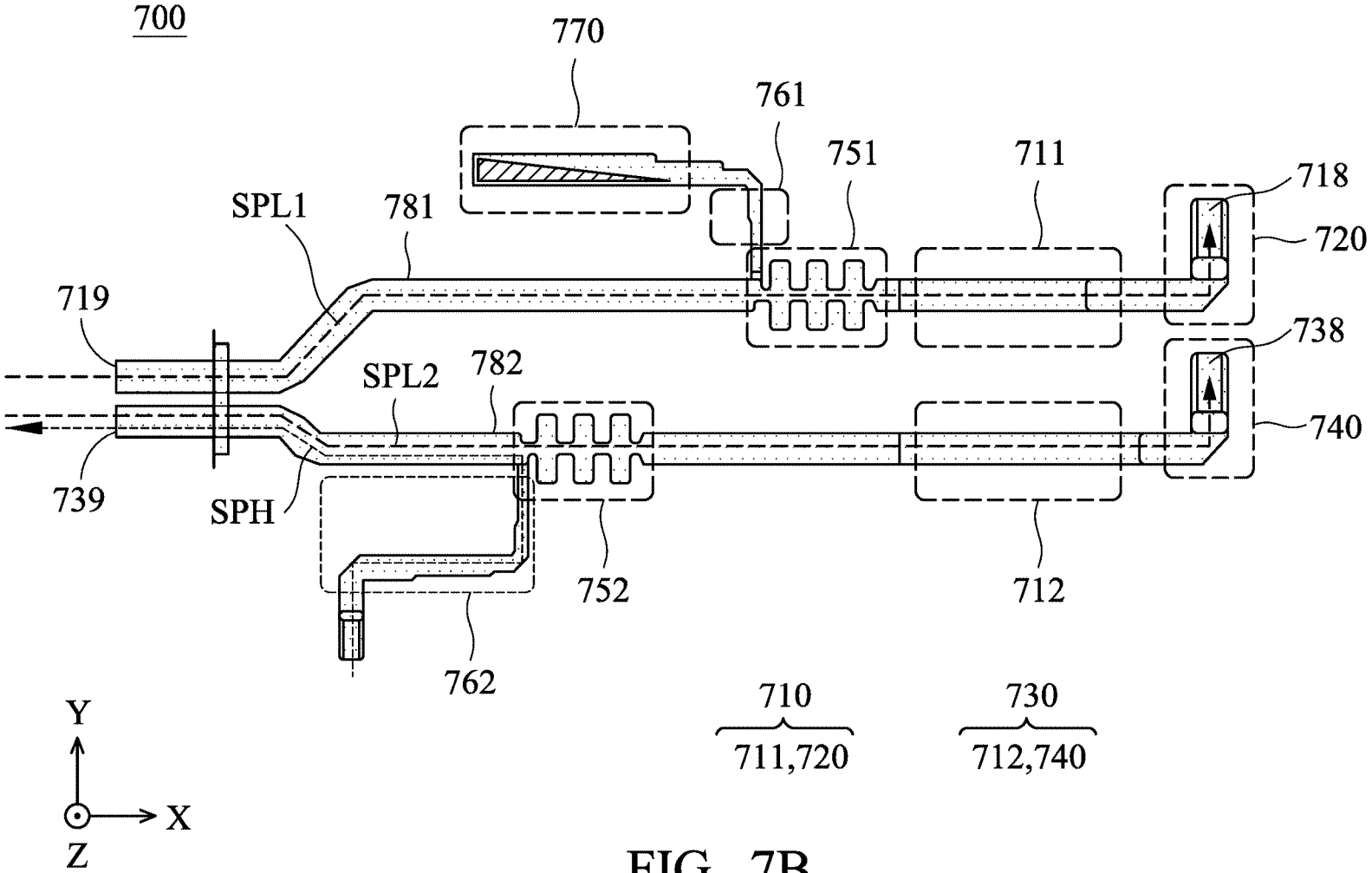
FIG. 7B is a top view of a frequency division element according to an embodiment of the invention.
Figure 7C:
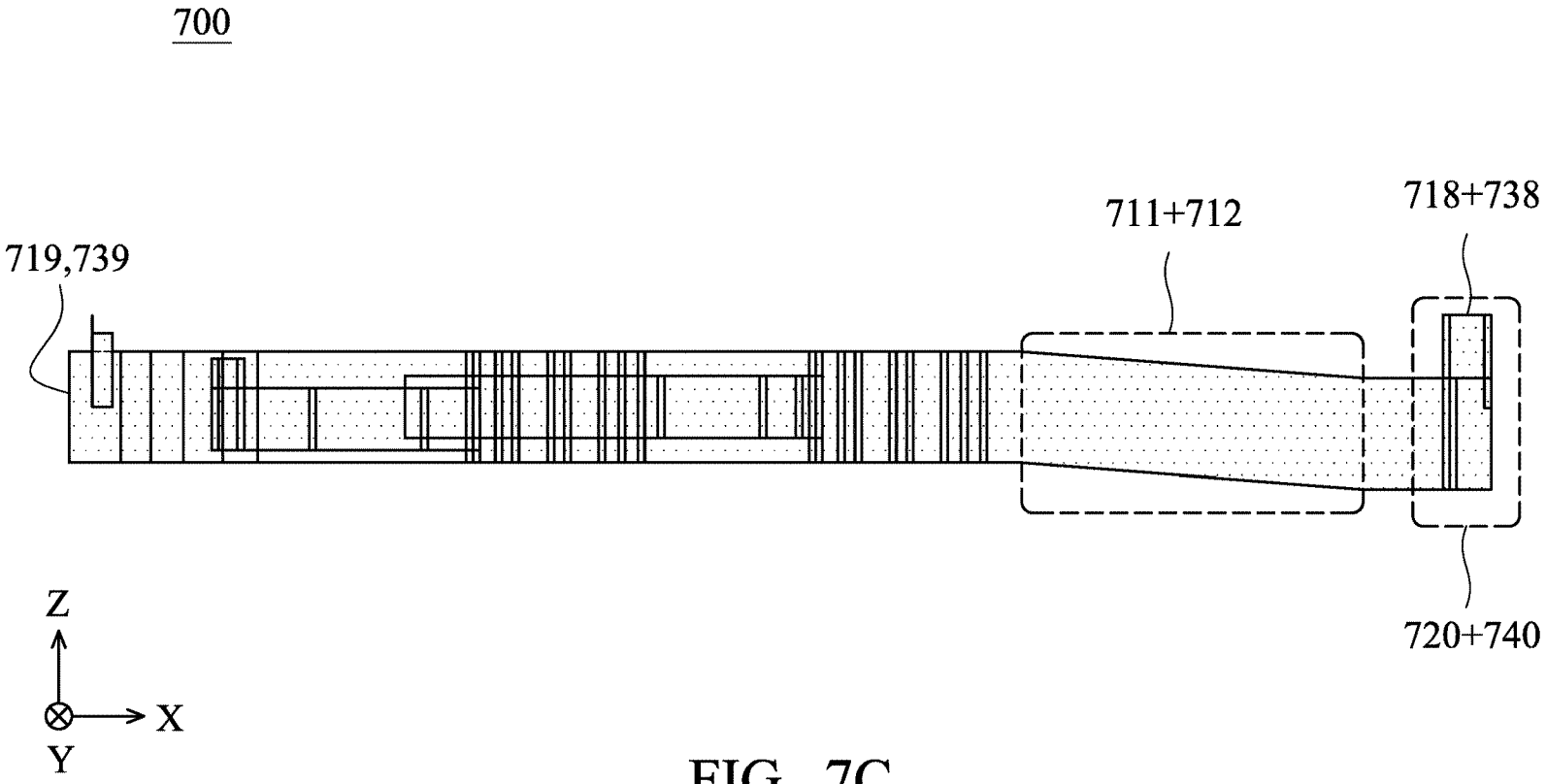
FIG. 7C is a side view of a frequency division element according to an embodiment of the invention.
Figure 7D:
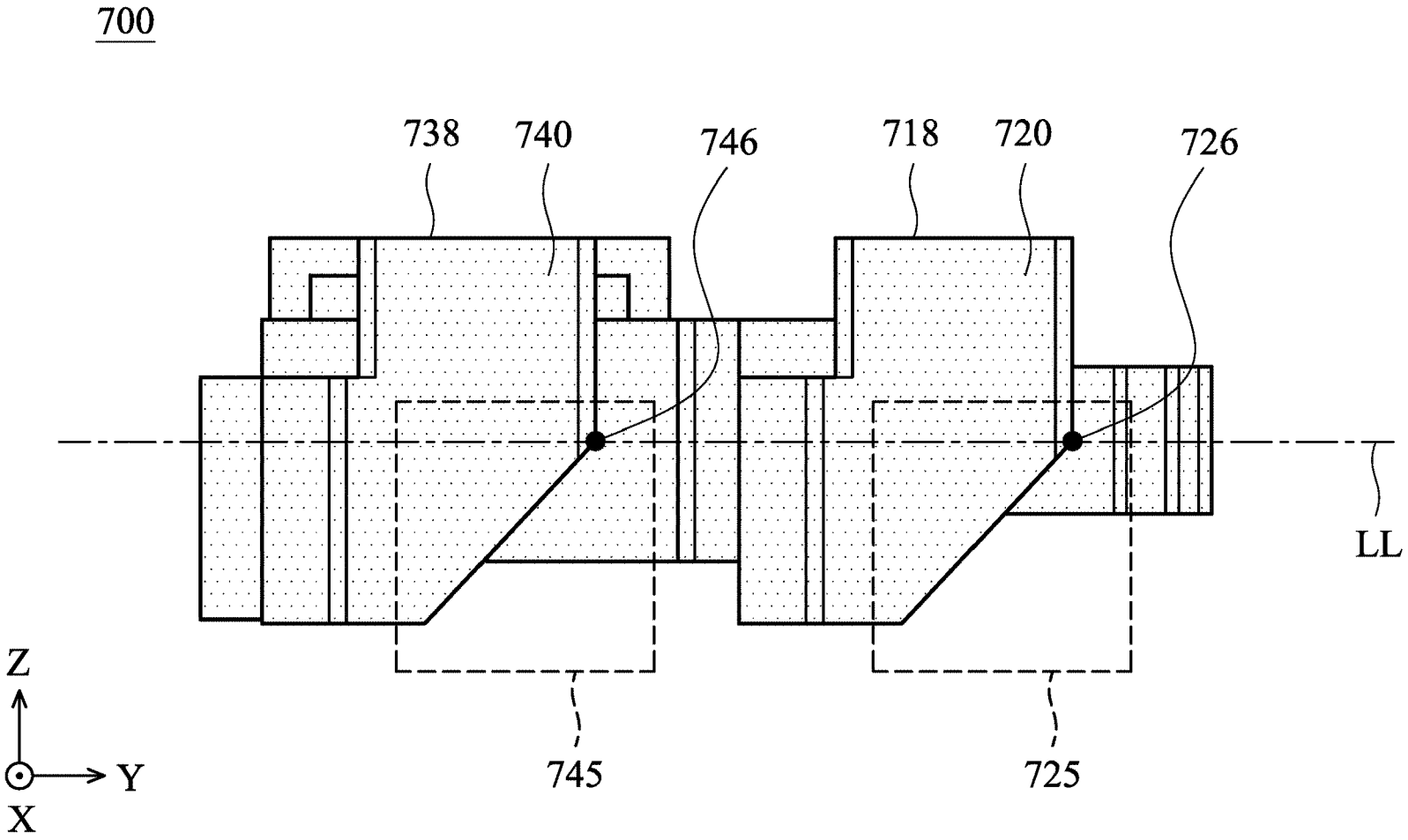
FIG. 7D is a side view of a frequency division element according to an embodiment of the invention.

FIG. 7A is a perspective view of the frequency division element 700 according to an embodiment of the invention. FIG. 7B is a top view (XY plane) of the frequency division element 700 according to an embodiment of the invention. FIG. 7C is a side view (XZ plane) of the frequency division element 700 according to an embodiment of the invention. FIG. 7D is a side view (YZ plane) of the frequency division element 700 according to an embodiment of the invention. Please refer to FIGS. 7A to 7D together. The frequency division element 700 may include at least one of a first waveguide 720 and a second waveguide 730. Each of the first waveguide 720 and the second waveguide 730 may be a metal hollow structure.

The first waveguide 710 at least includes a first descending portion 711 and a first terminal bending portion 720 which are connected to each other. When the first descending portion 711 of the first waveguide 710 extends along the +X axis, the height of the first descending portion 711 in the +Z axis may gradually decrease. The first terminal bending portion 720 of the first waveguide 710 has a terminal portion 718 bent substantially 90 degrees thereby being extended along the +Y axis, such that the terminal portion 718 of the first waveguide 710 is coupled to the first receiver module 641 more easily. In order to suppress the transfer loss at the right-angle bend, the first terminal bending portion 720 of the first waveguide 710 has a first chamfer angle 725. The first descending portion 711 of the first waveguide 710 is configured to reduce the height of the first terminal bending portion 720 in the +Z axis. Accordingly, at least one edge 726 of the first chamfer angle 725 can be aligned with a parting line LL.

The second waveguide 730 at least includes a second descending portion 712 and a second terminal bending portion 740 which are connected to each other. When the second descending portion 712 of the second waveguide 730 extends along the +X axis, the height of the second descending portion 712 in the +Z axis may gradually decrease. The second terminal bending portion 740 of the second waveguide 730 has a terminal portion 738 bent substantially 90 degrees thereby being extended along the +Y axis, such that the terminal portion 738 of the second waveguide 730 is coupled to the second receiver module 642 more easily. In order to suppress the transfer loss at the right-angle bend, the second terminal bending portion 740 of the second waveguide 730 has a second chamfer angle 745. The second descending portion 712 of the second waveguide 730 is configured to reduce the height of the second terminal bending portion 740 in the +Z axis. Accordingly, at least one edge 746 of the second chamfer angle 745 can be aligned with the aforementioned parting line LL.

If the first waveguide 710 and the second waveguide 730 do not include the descending structures, i.e. the first descending portion 711 and the second descending portion 712, the first terminal bending portion 720 and the second terminal bending portion 740 would be too high in the +Z axial direction, and therefore it would be difficult to perform a mold release process during the manufacturing process of the frequency division element 700. Without using any descending structures, the edge 726 of the first chamfer angle 725 and the edge 746 of the second chamfer angle 745 could not be aligned with the parting line LL (i.e., their heights in the +Z axial direction will be located above the parting line LL). Practically, each of the first waveguide 710 and the second waveguide 730 is formed by assembling an upper part with a lower part that were molded separately; under the above scenario (no descending structures included), the upper parts and the lower parts meet at the parting line LL having the edges 726 and 746 of the first and second chamfer angles 725 and 745 located above the parting line LL. During mold release process following on the molding of the upper parts, a male mold and a female mold for forming the upper parts of the first waveguide 710 and the second waveguide 730 will be separated from each other from the parting line LL along Z-axis. Hook-like structures of the upper parts' female mold (figure not shown) for forming upper portions of the first chamfer angle 725 and the second chamfer angle 745 will be stuck by the upper portions of the first chamfer angle 725 and the second chamfer angle 745. Therefore, by implementing of the first descending portion 711 and the second descending portion 712, the need of the hook-like structures of the upper parts' female mold can be eliminated, so that the upper parts' female mold can be released directly along the Z-axis. With the proposed design of the invention (as shown in FIG. 7D), the male mold and the female mold can be easily separated from each other from the parting line LL, thereby significantly reducing the difficulty of the mold release process of the frequency division element 700.

In some embodiments, the first waveguide 710 further includes one or more of a first low-pass filter 751, a first high-pass filter 761, a waveguide load 770, and a first connection element 781. The first descending portion 711 of the first waveguide 710 is connected between the first terminal bending portion 720 of the first waveguide 710 and one end of the first low-pass filter 751. Specifically, the first low-pass filter 751 has a height perpendicular to its signal transmission direction (e.g., +X axis or −X axis), and the parting line LL extends and passes the position at a half of the height of the first low-pass filter 751. The first high-pass filter 761 and the first connection element 781 are both connected to another end of the first low-pass filter 751. The waveguide load 770 is connected through the first high-pass filter 761 to the first low-pass filter 750. The waveguide load 770 may be implemented with an absorption element for fine-tuning the impedance matching of the first waveguide 710. The first connection element 781 is further connected to another terminal portion 719 of the first waveguide 710. The terminal portion 719 may be further coupled to the polarizer 660 and the system antenna 670.

In some embodiments, the second waveguide 730 further includes one or more of a second low-pass filter 752, a second high-pass filter 762, and a second connection element 782. The second descending portion 712 of the second waveguide 730 is connected between the second terminal bending portion 740 of the second waveguide 730 and one end of the second low-pass filter 752. The second high-pass filter 762 and the second connection element 782 are both connected to another end of the second low-pass filter 752. The second high-pass filter 762 may be further coupled to the transmitter module 643. The second connection element 782 may be further connected to another terminal portion 739 of the second waveguide 730. The terminal portion 739 may be further coupled to the polarizer 660 and the system antenna 670.

When the frequency division element 700 is operated, it can provide a first signal path SPL1, a second signal path SPL2, and a third signal path SPH. The first signal path SPL1 begins from the system antenna 670 and the polarizer 660, through the first connection element 781, the first low-pass filter 751, the first descending portion 711, and the first terminal bending portion 720 of the first waveguide 710, and finally reaches the first receiver module 641 (i.e., the aforementioned signal path of the first reception signal SR1). The second signal path SPL2 begins from the system antenna 670 and the polarizer 660, through the second connection element 782, the second low-pass filter 752, the second descending portion 712, and the second terminal bending portion 740 of the second waveguide 730, and finally reaches the second receiver module 642 (i.e., the aforementioned signal path of the second reception signal SR2). The third signal path SPH begins from the transmitter module 643, through the second high-pass filter 762 and the second connection element 782 of the second waveguide 730, and finally reaches the polarizer 660 and the system antenna 670 (i.e., the aforementioned signal path of the transmission signal ST). It should be understood that although FIGS. 7A to 7D show the whole structure of the frequency division element 700, in other embodiments, the frequency division element 700 may include only a part of these components according to different requirements. For example, each waveguide may merely include a corresponding descending portion and a corresponding terminal bending portion.

Figure 8:
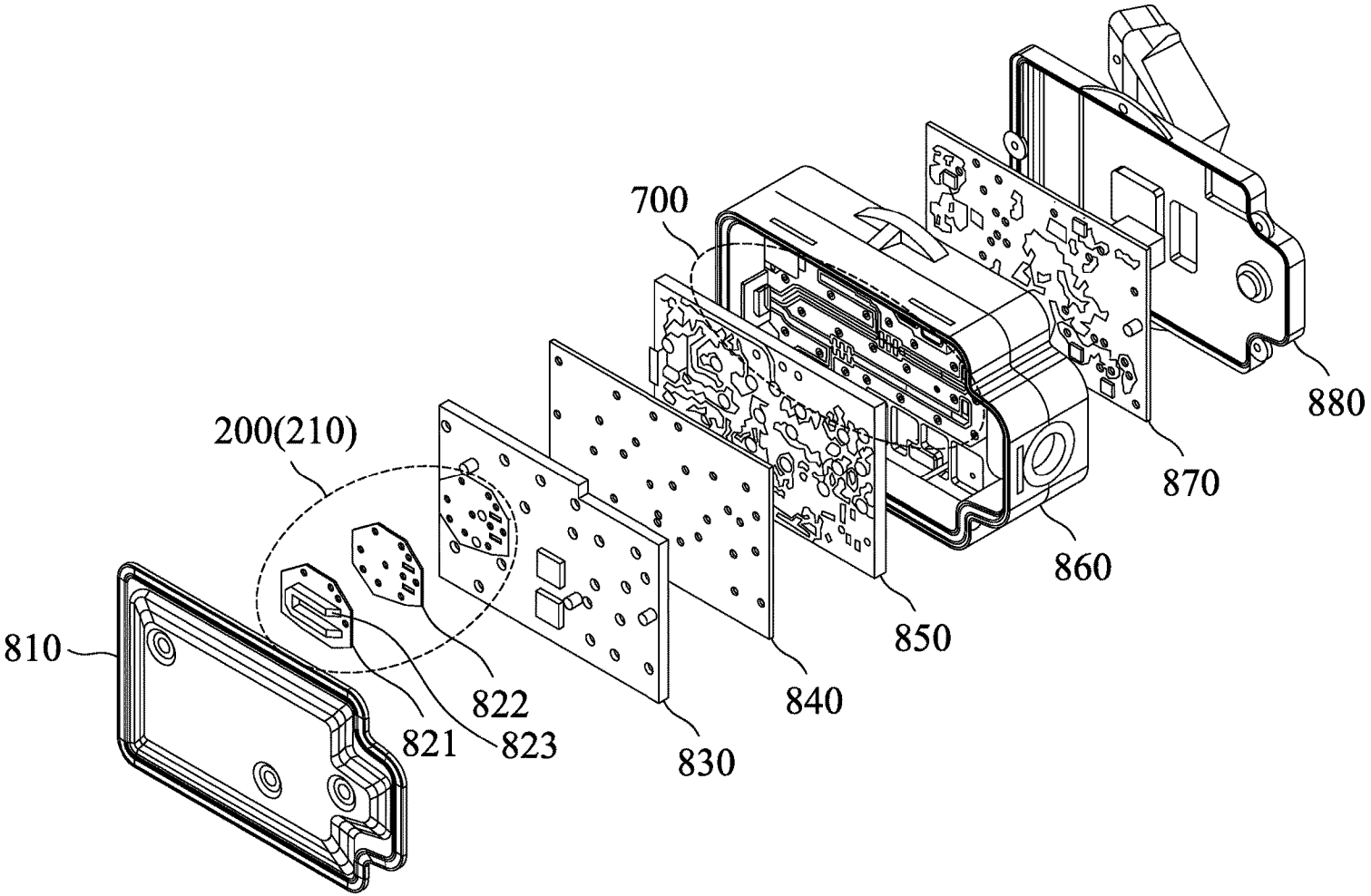
FIG. 8 is an exploded view of an outdoor unit according to another embodiment of the invention.

FIG. 8 is an exploded view of an ODU 800 according to another embodiment of the invention. The embodiment of FIG. 8 describes the physical element structures of the outdoor units 600 and 690 of FIGS. 6A and 6B. In the embodiment of FIG. 8, the outdoor unit 800 includes a top cover 810, a filter cover 821, a filter plate 822, an RF spacer 830, an RF printed circuit board 840, a base 850, a housing 860, a baseband printed circuit board 870, and a support element 880.

Figure 9:
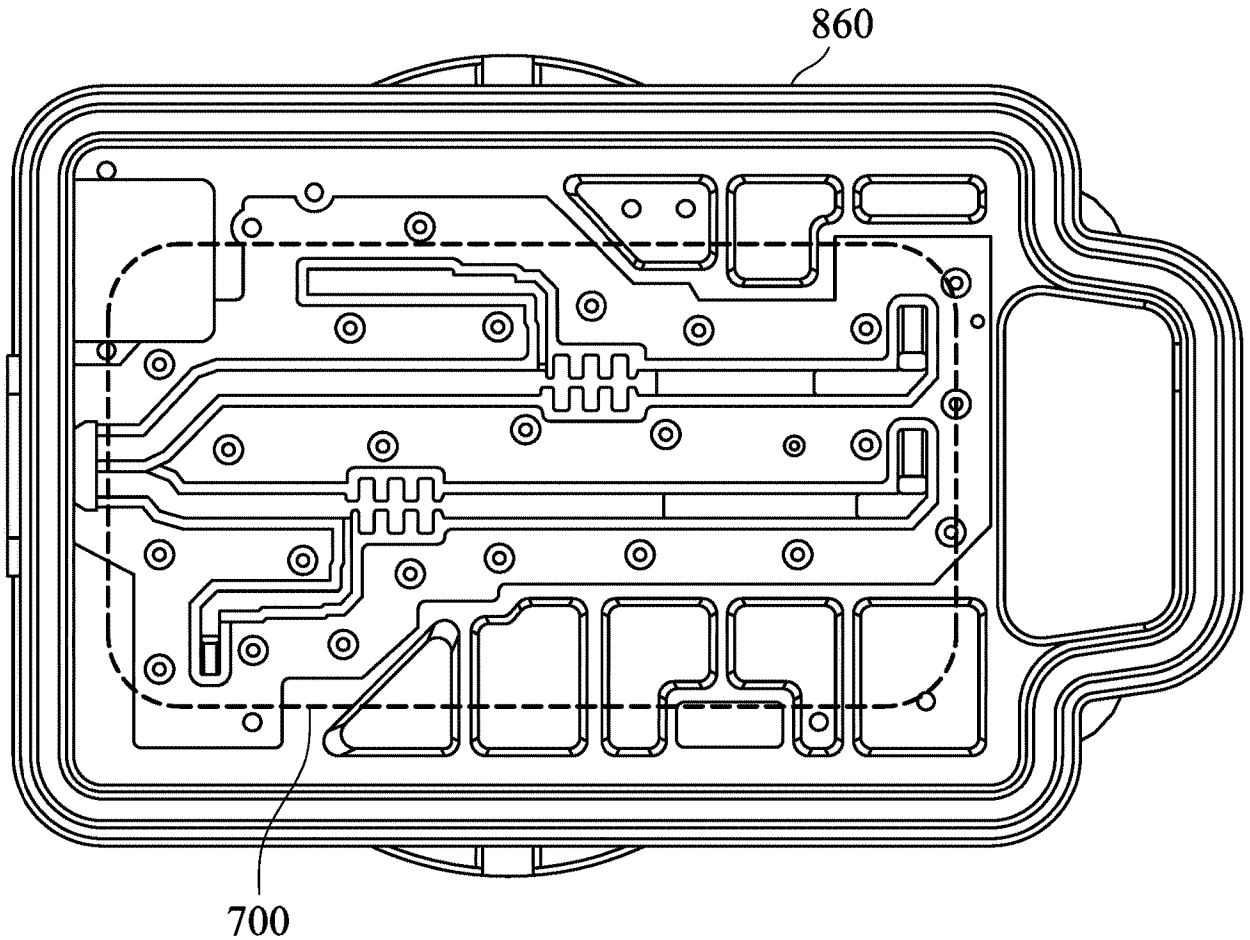
FIG. 9 is a view of a frequency division element embedded in a housing according to an embodiment of the invention.

The top cover 810 has the function of waterproof, and it is configured to protect the outdoor unit 800 from being damaged by rain. The filter cover 821 has a waveguide groove 823. The filter plate 822 supports the filter cover 821 and adheres to the waveguide groove 823 so as to form the waveguide chamber 215, which includes the high-pass portion 220, the connection portion 230, and the low-pass portion 240. The aforementioned band-pass filter device 200 and its waveguide filter 210 may be formed by the filter cover 821 and the filter plate 822. The filter cover 821 and the filter plate 822 are disposed between the top cover 810 and the RF spacer 830, and are locked and attached to the top of the RF spacer 830. The RF spacer 830 may be made of a metal material. The RF spacer 830 can reduce the interference between transmission signals and reception signals. There may be a plurality of screws disposed on the RF spacer 830. The filter plate 822 lies on the RF spacer 830, so as to cover the aforementioned screws. The filter plate 822 also provides a flat plane for supporting the filter cover 821. The RF printed circuit board 840 (or 207) is disposed between the RF spacer 830 and the base 850. The RF printed circuit board 840 accommodates the first receiver module 641, the second receiver module 642, and the transmitter module 643 of the aforementioned RF module 640. The aforementioned frequency division element 700 may be formed by the housing 860 (i.e. the upper parts of the waveguides 710 and 730) and the base 850 (i.e. the lower parts of the waveguides 710 and 730). The aforementioned parting line LL is positioned at the junction where the housing 860 and the base 850 meet. That is, the parting line LL is considered as a mold junction line between the housing 860 and the base 850 of the present invention. FIG. 9 is a view of the frequency division element 700 embedded in the housing 860 according to an embodiment of the invention. The baseband printed circuit board 870 accommodates the aforementioned baseband module 650. The support element 880 supports the whole outdoor unit 800. The baseband printed circuit board 870 is disposed between the housing 860 and the support element 880. It should be understood that although FIGS. 8 and 9 display the whole structure of the outdoor unit 800, in other embodiments, the outdoor unit 800 may include only a part of these components according to different requirements. Furthermore, the elements of FIG. 8 can be coupled to each other through one or more conductive via elements (not shown), so as to form the aforementioned signal paths.

The invention proposes a novel band-pass filter device, a novel method for signal transmission, and a novel outdoor unit. The band-pass filter device and the method for signal transmission can improve the signal quality, and enhance the tolerance to variations in the manufacturing process. The outdoor unit has all of the advantages of the band-pass filter device, and its waveguide descending structure further reduces the difficulty of the mold release process during the manufacturing process. Accordingly, the invention is suitable for application in a variety of satellite communication devices.

Note that the above element sizes, element shapes, and frequency ranges are not limitations of the invention. An antenna designer can fine-tune these settings or values according to different requirements. It should be understood that the band-pass filter device, the method for signal transmission, and the outdoor unit of the invention are not limited to the configurations of FIGS. 1 to 9. The invention may merely include any one or more features of any one or more embodiments of FIGS. 1 to 9. In other words, not all of the features displayed in the figures should be implemented in the band-pass filter device, the method for signal transmission, and the outdoor unit of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A band-pass filter device, comprising:

a waveguide filter having a waveguide chamber, wherein the waveguide chamber comprises a high-pass portion, a connection portion, and a low-pass portion;

a first circuit board section;

a first antenna, disposed on the first circuit board section;

a second circuit board section; and a second antenna, disposed on the second circuit board section;

wherein the first antenna is capable of generating a wireless signal to be transmitted through the high-pass portion, the connection portion, and the low-pass portion of the waveguide filter, and then received by the second antenna.

2. The band-pass filter device as claimed in claim 1, wherein the first circuit board section transmits a first wired signal, and the second circuit board section transmits a second wired signal, wherein the first antenna converts the first wired signal into the wireless signal, and the second antenna converts the wireless signal into the second wired signal.

3. The band-pass filter device as claimed in claim 1, wherein the waveguide filter substantially has a U-shape with a first reflection end and a second reflection end, wherein the first antenna and the first circuit board section are disposed in an end portion including the first reflection end of the waveguide filter, and the second antenna and the second circuit board section are disposed in an end portion including the second reflection end of the waveguide filter.

4. The band-pass filter device as claimed in claim 1, wherein the low-pass portion of the waveguide filter is a corrugated-waveguide filter.

5. The band-pass filter device as claimed in claim 1, wherein the waveguide filter further comprises:

a filter cover, having a waveguide groove; and a filter plate, supporting the filter cover, and configured to be adhered to the waveguide groove so as to form the waveguide chamber.

6. The band-pass filter device as claimed in claim 1, wherein the high-pass portion of the waveguide filter is configured to remove electromagnetic waves whose frequency is lower than 28 GHz.

7. The band-pass filter device as claimed in claim 1, wherein the low-pass portion of the waveguide filter is configured to remove electromagnetic waves whose frequency is higher than 30.5 GHz.

8. A method for signal transmission, comprising the steps of:

providing a waveguide filter, a first antenna, a second antenna, a first circuit board section, and a second circuit board section, wherein the waveguide filter comprises a high-pass portion and a low-pass portion, wherein the first antenna is disposed on the first circuit board section, and wherein the second antenna is disposed on the second circuit board section;

transmitting a first wired signal from the first circuit board section to the first antenna;

converting the first wired signal into a wireless signal by the first antenna;

transmitting the wireless signal through the high-pass portion and the low-pass portion of the waveguide filter;

receiving the wireless signal by the second antenna; and converting the wireless signal into a second wired signal, and transmitting the second wired signal to the second circuit board section.

9. The method as claimed in claim 8, further comprising:

when the wireless signal passes through the high-pass portion, removing electromagnetic waves whose frequency is lower than 28 GHz; and when the wireless signal passes through the low-pass portion, removing electromagnetic waves whose frequency is higher than 30.5 GHz.

10. An outdoor unit, comprising:

a band-pass filter device, comprising:

a waveguide filter having a waveguide chamber, wherein the waveguide chamber comprises a high-pass portion, a connection portion, and a low-pass portion;

a first circuit board section;

a first antenna, disposed on the first circuit board section;

a second circuit board section; and a second antenna, disposed on the second circuit board section;

wherein the first antenna is capable of generating a wireless signal to be transmitted through the high-pass portion, the connection portion, and the low-pass portion of the waveguide filter, and then received by the second antenna; and a frequency division element, coupled through an RF (Radio Frequency) printed circuit board to the band-pass filter device, wherein the frequency division element comprises:

a first waveguide, at least comprising a first descending portion gradually extended downwardly, and a first terminal bending portion connected to an end of the first descending portion, wherein the first terminal bending portion has a first chamfer angle, and an edge of where the first chamfer angle bends is aligned with a parting line.

11. The outdoor unit as claimed in claim 10, wherein the first waveguide further comprises a first low-pass filter having a height perpendicular to its signal transmission direction, and wherein the parting line extends and passes a position at a half of the height of the first low-pass filter.

12. The outdoor unit as claimed in claim 10, further comprising:

a housing; and a base, wherein the frequency division element is formed by the housing and the base, and the parting line is a junction where the housing and the base meet.

13. The outdoor unit as claimed in claim 10, wherein the first waveguide further comprises a first low-pass filter, and the first descending portion is connected between and gradually extended downwardly from the first low-pass filter to the first terminal bending portion.

14. The outdoor unit as claimed in claim 13, wherein the first waveguide further comprises a first high-pass filter and a waveguide load connected through the first high-pass filter to the first low-pass filter.

15. The outdoor unit as claimed in claim 10, wherein the frequency division element further comprises:

a second waveguide, at least comprising a second descending portion gradually extended downwardly, and a second terminal bending portion connected to an end of the first descending portion, wherein the second terminal bending portion has a second chamfer angle, and an edge of where the second chamfer angle bends is aligned with the parting line.

16. The outdoor unit as claimed in claim 15, wherein the second waveguide further comprises a second low-pass filter, and the second descending portion is connected between and gradually extended downwardly from the second low-pass filter to the second terminal bending portion.

17. The outdoor unit as claimed in claim 16, wherein the second waveguide further comprises a second high-pass filter coupled to the second low-pass filter.

18. The outdoor unit as claimed in claim 12, wherein the waveguide filter further comprises:

a filter cover, having a waveguide groove; and a filter plate, supporting the filter cover, and adhered to the waveguide groove so as to form the waveguide chamber.

19. The outdoor unit as claimed in claim 18, further comprising:

a top cover;

an RF spacer, wherein the filter cover and the filter plate are disposed between the top cover and the RF spacer, and wherein the RF printed circuit board is disposed between the RF spacer and the base;

a baseband printed circuit board; and a support element, wherein the baseband printed circuit board is disposed between the housing and the support element.

* * * * *